US009112324B2

(12) United States Patent
Shen

(10) Patent No.: US 9,112,324 B2
(45) Date of Patent: Aug. 18, 2015

(54) COAXIAL CONNECTOR WITH DETECTING STRUCTURE

(71) Applicant: GRAND-TEK TECHNOLOGY CO., LTD., New Taipei (TW)

(72) Inventor: Kung-Yu Shen, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/159,450

(22) Filed: Jan. 21, 2014

(65) Prior Publication Data

US 2014/0213122 A1 Jul. 31, 2014

(30) Foreign Application Priority Data

Jan. 29, 2013 (TW) ..... 102103376 A

(51) Int. Cl.
*H01R 3/00* (2006.01)
*H01R 24/50* (2011.01)
*H01R 24/46* (2011.01)

(52) U.S. Cl.
CPC ..... *H01R 24/50* (2013.01); *H01R 24/46* (2013.01); *H01R 2201/02* (2013.01)

(58) Field of Classification Search
CPC ..... H01R 25/142; H01R 2013/00; H01R 13/641; H01R 13/7036
USPC ..... 439/94, 188, 489; 200/51.09
See application file for complete search history.

(56) References Cited

U.S. PATENT DOCUMENTS

| | | | | |
|---|---|---|---|---|
| 5,044,969 | A * | 9/1991 | Richier | 439/188 |
| 5,092,785 | A * | 3/1992 | Chen | 439/188 |
| 5,112,237 | A * | 5/1992 | Yang | 439/188 |
| 6,102,732 | A * | 8/2000 | Seko et al. | 439/489 |
| 7,537,468 | B1 * | 5/2009 | Huang et al. | 439/135 |
| 7,641,489 | B1 * | 1/2010 | Hsu et al. | 439/188 |
| 8,309,968 | B2 * | 11/2012 | Hwang et al. | 257/77 |
| 8,491,321 | B2 * | 7/2013 | Kobayashi | 439/181 |

* cited by examiner

*Primary Examiner* — Thanh Tam Le
(74) *Attorney, Agent, or Firm* — Chun-Ming Shih; HDLS IPR Services

(57) ABSTRACT

A coaxial connector includes a body, a female connector, and a detecting structure. The female connector has a pillar, and the pillar connects with the body. The detecting structure has a movable socket and a flexible conductor, wherein the movable socket is slidably sheathed on the pillar, and an interval space is formed between the movable socket and the pillar. The flexible conductor is located in the interval space, and has a detecting terminal. A part of the detecting terminal exposes to outside the movable socket, the movable socket pushes the flexible conductor toward the body in order to electrically connect the detecting terminal with the body. Hence, an RF (radio frequency) signal switching element on a mother board can be driven to switch between a build-in RF unit and an external RF unit.

16 Claims, 5 Drawing Sheets

COAXIAL CONNECTOR WITH DETECTING STRUCTURE

BACKGROUND OF THE INVENTION

1. Field of the Invention

The present invention generally relates to a connector, more particularly to a coaxial connector applied to network-communication electronic products.

2. Description of the Prior Art

A conventional coaxial connector is used to connect with a build-in RF (radio frequency) unit in equipment, but the build-in RF unit cannot provide satisfactory performance due to space and design constraint. Hence an additional external RF unit has to be added for enhancing signal transmission and reception. On the other hand, a problem is caused when using the build-in RF unit and the external RF unit simultaneously, that is, the two kinds of signals of the build-in RF unit and the external RF unit may be interfered with each other. Therefore, a coaxial connector with RF signal switch is needed to switch the signals of the build-in RF unit and the external RF unit.

Traditionally, network-communication electronic products are all provided with the build-in RF unit. The build-in RF unit may not have a good performance in transmitting and receiving signals due to the volume constraint of the network-communication electronic product. As a result, to add an external RF unit on the network-communication electronic product is able to enhance the effects of transmitting and receiving signals.

However, the external RF unit is externally connected with the network-communication electronic product, and the build-in RF unit in the network-communication electronic product may not be turned off automatically when the external RF unit is used. As a result, the two RF units are turned on simultaneously, and it causes the signal interference of the two RF units. As it can be seen, such situation shall be solved in order to avoid the interference.

SUMMARY OF THE INVENTION

The present invention is to provide a coaxial connector with a detecting structure, so that an RF signal switching element can be directly installed on a mother board to switch between a build-in RF unit and an external RF unit.

The present invention provides a coaxial connector comprising a body, a female connector, and a detecting structure. The female connector has a pillar, and the pillar connects with the body. The detecting structure has a movable socket and a flexible conductor, wherein the movable socket slides to sheath on the pillar, and an interval space is formed between the movable socket and the pillar. The flexible conductor is disposed in the interval space, and has a detecting terminal. A part of the detecting terminal exposes to outside of the movable socket, and the movable socket pushes the flexible conductor toward the body in order to electrically connect the detecting terminal with the body.

The present invention has the advantages described below. Since a spring is sheathed on a middle portion of the pillar, the movable socket is back to an original position via the compressed spring when a male connector disconnected from the female connector, therefore a build-in RF unit is re-used to transmit and receive signals.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Please refer to FIG. 1 to FIG. 4, and the present invention provides a coaxial connector. The coaxial connector comprises a body 10, a female connector 20, and a detecting structure 30.

The body 10 is a conductive member, and a plurality of ground terminals 11 are extended from a bottom end surface of the body 10.

Figure 4:
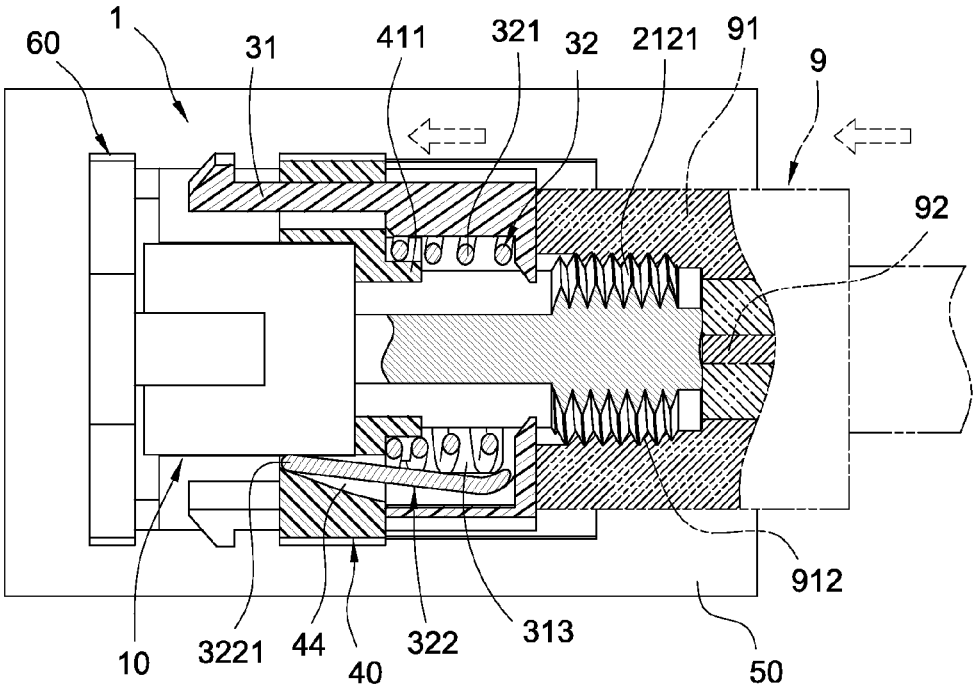
FIG. 4 illustrates a schematic application view of the first embodiment according to the present invention.

The female connector 20 is to connect with a male connector 9, as shown in FIG. 4. The female connector 20 comprises a pillar 21 that is a conductive member. The pillar 21 has a middle section 211 and a free section 212. An end of the middle section 211 connects to the body 10. The free section 212 is formed by extending an end of the middle section 211 away from the body 10. An external thread 2121 is formed on a peripheral surface of the free section 212. An end surface of the free section 212 away from the body 10 has a connecting opening 2122.

The female connector 20 yet comprises a conductive terminal 22. The conductive terminal 22 has a first signal transmitting section 221 and a second signal transmitting section 222. The first signal transmitting section 221 is disposed in the pillar 21, and an end portion of the first signal transmitting section 221 exposes to the connecting opening 2122. The other end of the first signal transmitting section 221 close to the body 10 extends to form the second signal transmitting section 222, and the second signal transmitting section 222 is disposed in the body 10. An end of the second signal transmitting section 222 away from the first signal transmitting section 221 penetrates through the body 10 and exposes to outside of the body 10.

Figure 1:
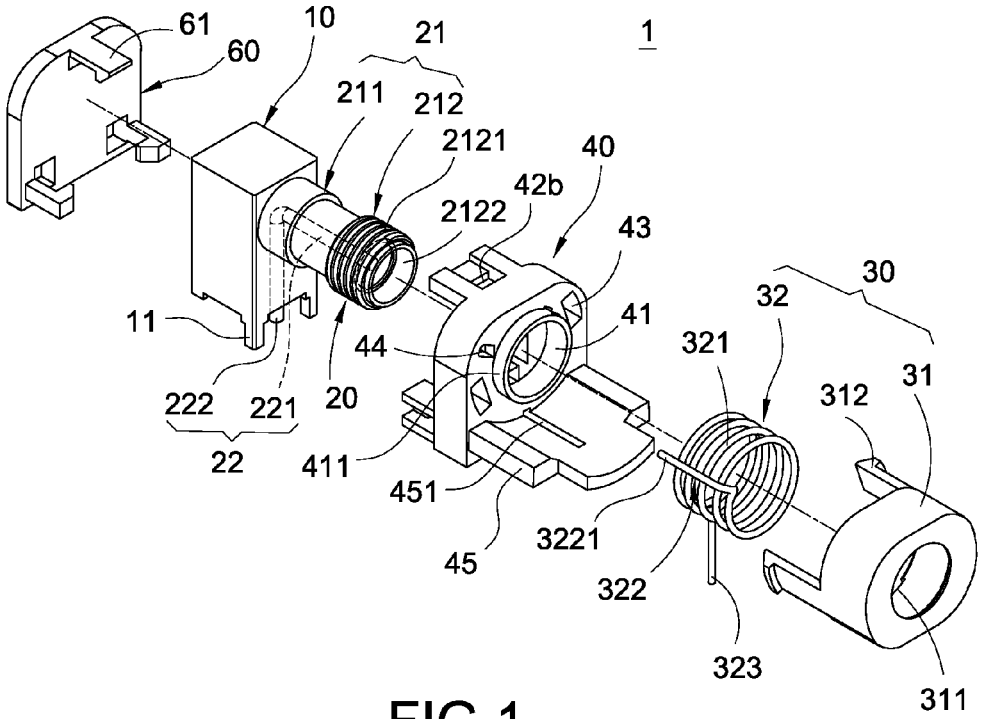
FIG. 1 illustrates a schematic perspective exploded view of a first embodiment according to the present invention.
Figure 2:
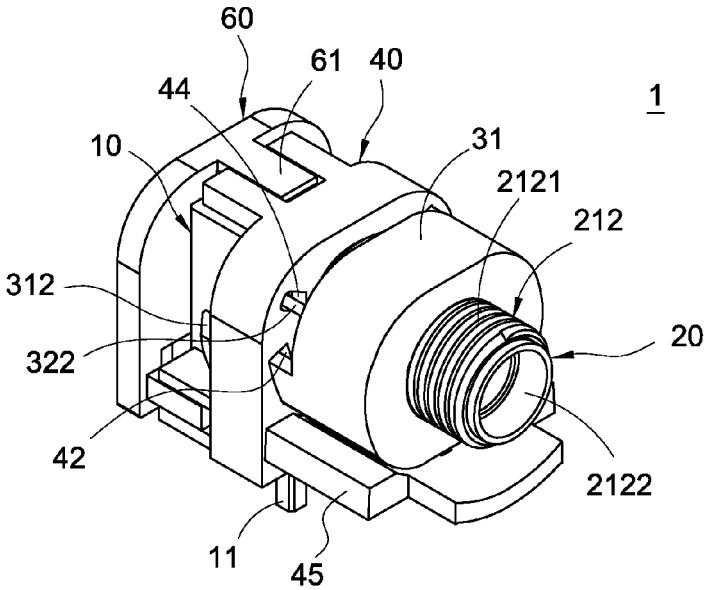
FIG. 2 illustrates a schematic perspective assembled view of the first embodiment according to the present invention.
Figure 3:
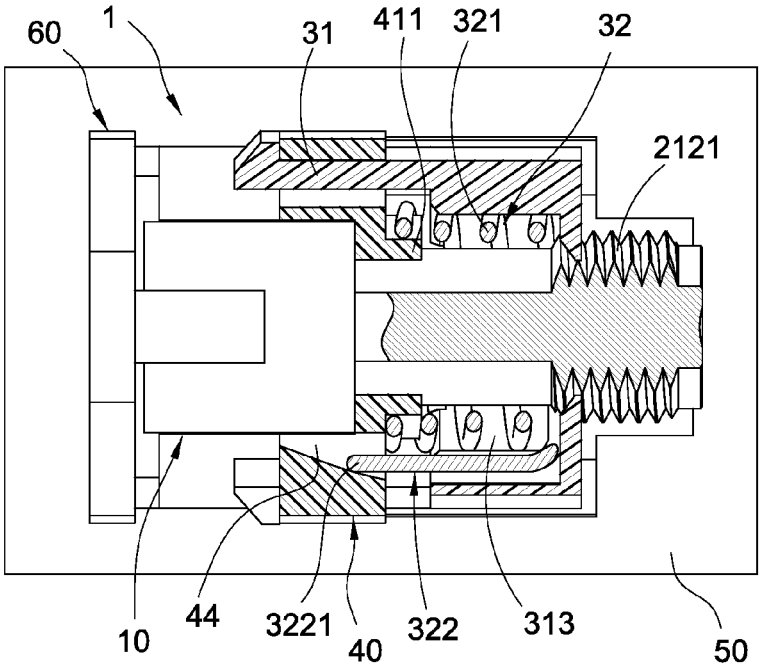
FIG. 3 illustrates a schematic sectional view of the first embodiment according to the present invention.

The detecting structure 30 further comprises a movable socket 31 and a flexible conductor 32. The movable socket 31 has a hollow channel 311 and at least one first hook 312. The movable socket 31 is slidably sheathed on the middle section 211 of the pillar 21, and the middle section 211 is located in the hollow channel 311, so an interval space 313 is formed between a wall surface of the hollow channel 311 and the middle section 211 of the pillar 21, as shown in FIG. 3. The first hook 312 is extended from an end of the movable socket 31 toward the body 10, wherein the end of the movable socket 31 is close to the body 10. If the amount of the first hook 312 is plural, the plurality of first hooks 312 are arranged by spaced at intervals.

The flexible conductor 32 is a conductive member, and has a spring 321. The spring 321 is sheathed on the middle portion 211 of the pillar 21, and is disposed in the interval space 313. The flexible conductor 32 has a detecting terminal 322 and a potential terminal 323, wherein the detecting terminal 322 is formed by bending and extending an end of the spring 321 away from the body 10, and a direction of bending and extending the end is toward the body 10, and the potential terminal 323 is formed by bending and extending the other end of the spring 321 close to the body 10. The detecting terminal 322 and the potential terminal 323 are conductive members. A distal end of the detecting terminal 322 close to the body 10 is an abutting section 3221. A part of the abutting section 3221 is protruded out of the interval space 313 so as to expose to outside of the hollow channel 311.

The connector 1 further comprises a fixing plate 40. The fixing plate 40 has a hole 41, at least one fastening slot 42*b*, at least one connecting through hole 43, and at least one through hole 44. The hole 41 is at a center portion of the fixing plate 40. The middle section 211 of the pillar 21 is through the hole 41, and a peripheral edge of the hole 41 of the fixing plate 40 extends toward a direction away from the body 10 to form a collar 411. An end of the spring 321 close to the body 10 connects on the collar 411, hence the collar 411 is between the pillar 21 and the spring 321. In addition, the fixing plate 40 is between the body 10 and the movable socket 31.

The connecting through hole 43 is beside the hole 41, and is for the first hook 312 of the movable socket 31 sliding in, penetrating through, connecting with, and fastening up. Then the movable socket 31 is fixed on the fixing plate 40 via the first hook 312 fastening up the connecting through hole 43, and the fixing plate 40 thus connects with the body 10. When the amount of the connecting through hole 43 is plural, the connecting through holes 43 are arranged by spaced at intervals, and each of the connecting through holes 43 is corresponding to each of the first hooks 312.

The through hole 44 of the fixing plate 40 is a tapered hole that is tapered from an end of the through hole 44 close to the female connector 20 to the other end of the through hole 44 close to the body 10, so that the through hole 44 is for the detecting terminal 322 of the flexible conductor 32 sliding in and connecting with. The abutting section 3221 of the detecting terminal 322 urges on an inner surface of the through hole 44. A lower end edge of an end surface of the fixing plate 40 extends toward the direction away from the body 10 to form an elongation section 45, and the end surface of the fixing plate 40 is away from the body 10. The elongation section 45 has a sliding slot 451 for the potential terminal 323 sliding in and connecting with.

The connector 1 yet comprises a fastening plate 60. The fastening plate 60 covers on an external surface of the body 10 away from the female connector 20, a top edge of the fastening plate 60 close to the body 10 extends to form at least one second hook 61. The second hook 61 fastens up in the fastening slot 42*b* of the fixing plate 40, so that the fixing plate 40 and the fastening plate 60 are fastened together, and therefore the fixing plate 40 and the fastening plate 60 are fixed on the body 10.

Figure 5:
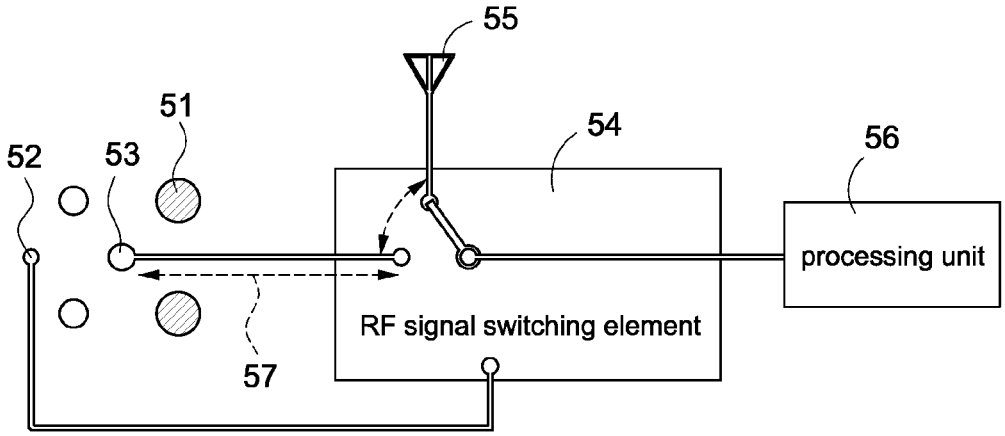
FIG. 5 illustrates a circuit diagram of the first embodiment according to the present invention.

Please refer to FIG. 5 together with FIG. 1 to FIG. 4; before using, a plurality of ground terminals 11 of the body 10, the second signal transmitting section 222 of the female connector 20, and the potential terminal 323 of the spring 321 are securely fixed on a mother board 50 and are electrically connected with the mother board 50.

The mother board 50 has a plurality of conductive pin holes 51, a signal pin hole 52, a signal receiving hole 53, an RF signal switching element 54, a build-in RF unit 55, and a processing unit 56. The RF signal switching element 54 electrically connects with the signal pin hole 52, the signal receiving hole 53, the build-in RF unit 55, and the processing unit 56. A conductive circuit 57 is formed between the signal receiving hole 53 and the RF signal switching element 54. The ground terminals 11 of the body 10 are inserted into the conductive pin holes 51, respectively. The potential terminal 323 of the spring 321 is inserted into the signal pin hole 52. The second signal transmitting section 222 of the conductive terminal 22 is inserted into the signal receiving hole 53.

When the male connector 9 is not connected with the female connector 20, the RF signal switching element 54 cuts off the conductive circuit 57, and the external signals received by the build-in RF unit 55 are thus transmitted to the processing unit 56 via the RF signal switching element 54, or the signals of the processing unit 56 are transmitted to other electronic products via the build-in RF unit 55.

When the male connector 9 of an external RF unit is connected with the female connector 20, a pillar 91 of the male connector 9 is able to move the movable socket 31 via an inner thread 912 engaging with the external thread 2121. The movable socket 31 then urges the flexible conductor 32 toward the body 10. Therefore, the abutting section 3221 of the detecting terminal 322 is urged by the inner surface of the through hole 44, so as to move to the body 10 and then electrically connect with the body 10. Such that a potential difference is produced when the detecting terminal 322 touches the body 10.

Figure 6:
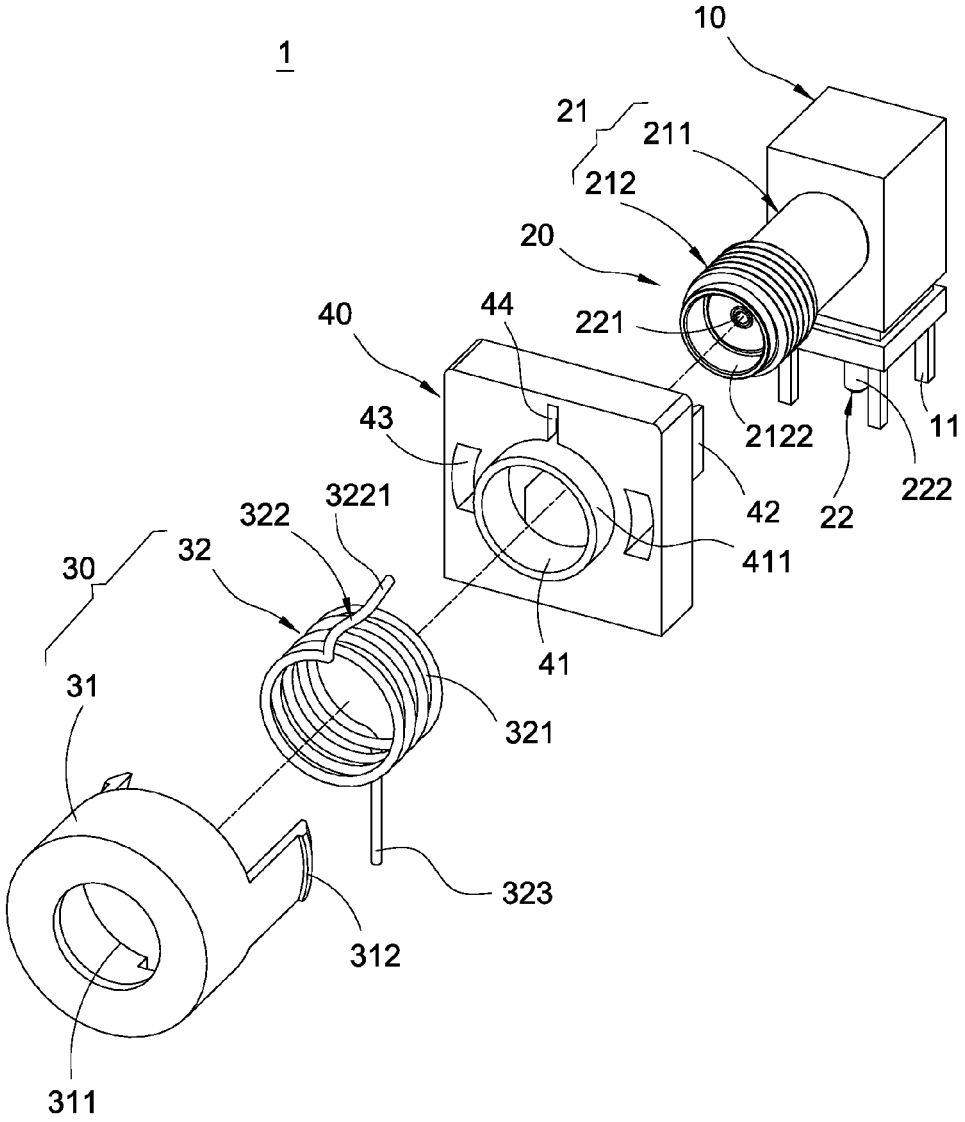
FIG. 6 illustrates a schematic perspective exploded view of a second embodiment according to the present invention.
Figure 7:
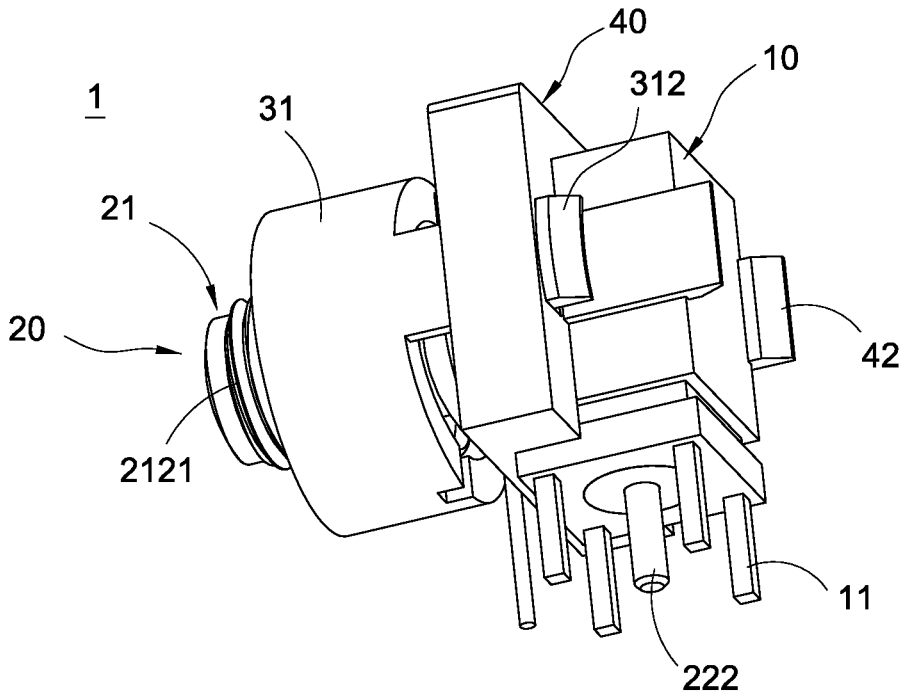
FIG. 7 illustrates a schematic perspective assembled view of the second embodiment according to the present invention.

Please refer to FIG. 6 and FIG. 7, which illustrate a schematic perspective exploded view of a second embodiment and a schematic perspective assembled view of the second embodiment according to the present invention. Compared to the aforesaid embodiment, the differences are that of the connector 1 in the second embodiment does not have the fastening plate 60 and the fastening slot 42*b* of the fixing plate 40 in the second embodiment is replaced by a third hook 42. Besides, the conductive terminal 22 of the female connector 20 has a first signal transmitting section 221 and a second signal transmitting section 222. The first signal transmitting section 221 is disposed in the pillar 21, and an end portion of the first signal transmitting section 221 exposes to the connecting opening 2122. The other end of the first signal transmitting section 221 close to the body 10 extends to form the second signal transmitting section 222, and the second signal transmitting section 222 is disposed in the body 10. In addition, an end of the second signal transmitting section 222 away from the first signal transmitting section 221 penetrates through the body 10 and exposes to outside of the body 10. When in assembly, the first hooks 312 of the movable socket 31 penetrate through the through holes 43 of the fixing plate 40 respectively, and the third hooks 42 of the fixing plate 40 directly fasten up the body 10, as shown in FIG. 7. As aforementioned, the second embodiment will be the same as the first embodiment in the aspect of functions.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A coaxial connector, comprising:

a body (10);

a female connector (20), having a pillar (21) connected with the body (10); and a detecting structure (30), comprising:

a movable socket (31), sliding to sheath on the pillar (21), an interval space (313) being formed between the movable socket (31) and the pillar (21); and a flexible conductor (32), located in the interval space (313), the flexible conductor (32) having a detecting terminal (322), a part of the detecting terminal (322) exposing out of the movable socket (31), the movable socket (31) pushing the flexible conductor (32) toward the body (10) in order to electrically connect the detecting terminal (322) with the body (10).

2. The coaxial connector according to claim 1, wherein the pillar (21) has a middle section (211) and a free section (212), the middle section (211) connecting with the body (10) and the free section (212) extending from the middle section (211) toward a direction away from the body (10), an external thread (2121) being formed on a peripheral surface of the free section (212), the movable socket (31) being slidably sheathed on the middle section (211), the interval space (313) being formed between the movable socket (31) and the middle section (211).

3. The coaxial connector according to claim 2, wherein the movable socket (31) has a hollow channel (311), the middle section (211) being located the hollow channel (311), the interval space (313) being formed between the middle section (211) and an inner wall of the hollow channel (311).

4. The coaxial connector according to claim 2, wherein the flexible conductor (32) has a spring (321), the spring (321) being sheathed on the middle section (211), the detecting terminal (322) being formed by bending and extending an end of the spring (321).

5. The coaxial connector according to claim 4, wherein a potential terminal (323) is formed by bending and extending other end of the spring (321).

6. The coaxial connector according to claim 5, further comprising a fixing plate (40) disposed between the body (10) and the movable socket (31), an end of the fixing plate (40) connecting with the body (10), other end of the fixing plate (40) connecting with the movable socket (31), the fixing plate (40) having a hole (41) for the middle section (211) penetrating through, a peripheral edge of the hole (41) extending to form a collar (411) toward the direction away from the body (10), the spring (321) being connected on the collar (411).

7. The coaxial connector according to claim 6, wherein an end of the movable socket (31) extends to form at least one hook (312), the end of the movable socket (31) being close to the body (10), an end of the hole of the fixing plate (40) having at least one connecting through hole (43) for the hook (312) sliding in, connecting with and fastening up.

8. The coaxial connector according to claim 6, wherein an end of the fixing plate (40) has a through hole (44) for the detecting terminal (322) sliding in.

9. The coaxial connector according to claim 8, wherein the through hole (44) is a tapered hole that is tapered from an end of the through hole (44) close to the female connector (20) to other end of the through hole (44) close to the body (10), an end portion of the detecting terminal (322) close to the body (10) urging on an inner surface of the through hole (44).

10. The coaxial connector according to claim 6, wherein an end surface of the fixing plate (40) close to the body (10) extends to form at least one hook (42), the hook (42) fastening up on an end surface of the body (10) away from the fixing plate (40).

11. The coaxial connector according to claim 6, further comprising a fastening plate (60), the fastening plate (60) covering on an external surface of the body (10) away from the female connector (20), an end edge of the fastening plate (60) close to the body (10) extending to form at least one hook (61), an end portion of the fixing plate (40) close to the body (10) having at least one fastening slot (42*b*) for the hook (61) fastening up.

12. The coaxial connector according to claim 6, wherein a lower end edge of an end surface of the fixing plate (40) extends to form an elongation section (45) toward the direction away from the body (10), and the end surface of the fixing plate (40) is away from the body (10), the elongation section (45) having a sliding slot (451) for the potential terminal (323) sliding in and connecting with.

13. The coaxial connector according to claim 1, wherein a plurality of ground terminals (11) are extended from a bottom surface of the body (10).

14. The coaxial connector according to claim 2, wherein the female connector (20) further comprises a conductive terminal (22), an end surface of the free section (212) away from the body (10) having a connecting opening (2122), an end portion of the conductive terminal (22) being in the pillar (21) and being formed a first signal transmitting section (221) that exposes in the connecting opening (2122), another end portion of the conductive terminal (22) being formed a second signal transmitting section (222) that is in the body (10), an end of the second signal transmitting section (222) away from the first signal transmitting section (221) penetrating and exposing to an external portion of the body (10).

15. The coaxial connector according to claim 1, wherein the body (10) and the flexible conductor (32) are two conductive members.

16. The coaxial connector according to claim 1, wherein the pillar (21) is a conductive member.

* * * * *